United States Patent [19]

Maxwell

[11] 4,358,905

[45] Nov. 16, 1982

[54] POWER DOZER

[76] Inventor: Donald Maxwell, P.O. Box 816, Viking, Alberta, Canada, T0B 4N0

[21] Appl. No.: 97,045

[22] Filed: Nov. 23, 1979

[51] Int. Cl.[3] ..... E02F 5/02; E02F 5/22

[52] U.S. Cl. ..... 37/100; 37/110; 37/142.5; 172/33; 172/63

[58] Field of Search ..... 172/1, 63, 66, 71, 33, 172/70; 37/142.5, 45.28, 99–102, 109, 110

[56] References Cited

U.S. PATENT DOCUMENTS

| | | | |
|---|---|---|---|
| 918,016 | 4/1909 | Dalton et al. | 172/66 |
| 1,617,538 | 2/1927 | Mowbray | 172/66 X |
| 2,402,976 | 7/1946 | Olson | 37/45 X |
| 3,091,873 | 6/1963 | West | 37/142.5 X |
| 3,119,193 | 1/1964 | Herschberger | 172/71 X |
| 3,362,092 | 1/1968 | Speicher et al. | 172/71 X |
| 3,777,822 | 12/1973 | Stedman et al. | 172/63 X |

FOREIGN PATENT DOCUMENTS

| | | |
|---|---|---|
| 294446 | 11/1929 | Canada . |
| 453607 | 12/1948 | Canada . |

*Primary Examiner*—Paul E. Shapiro

*Attorney, Agent, or Firm*—Lowe, Kokjer, Kircher, Wharton & Bowman

[57] ABSTRACT

This invention is directed to a unique method of moving earth and an earth moving device which can be attached at the front end of an endless track vehicle and used for moving earth into a ditch or excavation. The apparatus for moving earth comprises: (a) earth contacting blade; (b) an endless track mounted in association with the earth contacting blade for moving the earth in a direction lateral to the direction of travel of the earth contacting blade; and (c) a vehicle for moving blade (a) and track (b) above in co-operation with one another. The method of moving earth comprises advancing an earth moving blade through a continuous ridge of earth in a manner such that the speed of advance of the advancing earth moving blade is synchronized with the speed of movement of a laterally travelling earth moving track so that substantially all of the earth is moved laterally in the direction of travel of the laterally travelling earth moving track.

7 Claims, 6 Drawing Figures

POWER DOZER

This invention is directed to a novel earth moving device. More particularly, this invention is directed to a unique earth moving device which can be attached at the front end of an endless track vehicle and used for moving earth into a ditch or excavation.

BACKGROUND OF THE INVENTION

Returning earth efficiently and quickly into an excavation from which the earth has been removed has been a problem of long standing in the earth moving field. Many machines have been designed to handle this problem, the various machines solving the problem with varying degrees of success. A particularly troublesome problem, which has not been successfully solved, is returning removed earth back into a long ditch into which an oil or gas transmitting pipeline has been laid. In this application, using modern pipe laying methods, a long cleanly cut ditch is excavated across the countryside, after which the pipeline is laid in the ditch and is subsequently buried with the earth that has been removed from the ditch. When the ditch for the pipeline is being excavated, the removed earth is piled in a relatively neat elongated ridge alongside the ditch. If conventional earth moving equipment is used, it is difficult, without encountering considerable waste motion and time, to replace the removed earth in the ditch. An endless track vehicle commonly known as a dozer with an angled blade, is sometimes used, but the earth has a habit of piling up and spilling over both sides of the blades with the result that at least two passes with the dozer blade, and frequently more, must be made in order to fill the ditch. A dozer blade also has a tendency to compact the earth and move boulders, and earth lumps to the front, which when they drop into the ditch can cause damage to the protective coating on the pipe lying at the bottom of the ditch. Earth moving augers are also used for moving earth back into ditches, but they are less than completely successful for similar reasons.

In pipeline laying situations, it is sometimes necessary to lay a crude oil carrying pipeline in a right-of-way that is parallel to a natural gas carrying pipeline that is an adjacent right-of-way. In this situation it is important that no earth excavated for the second pipeline ditch is deposited on the right-of-way for the first laid pipeline, because the weight of heavy earth moving equipment on the ground above the first laid pipeline can cause damage to the first laid pipeline. It is difficult for conventional dozers and the like to deal with this problem because earth always tends to spill by both sides of the dozer blade.

Another problem is stripping top soil from a right-of-way. Often this must be done in very restricted widths, and the soil must not spill over onto the land adjoining the right-of-way. This is an increasingly common problem, for example, in subdivision areas, easements over densely occupied land, and the like. An earth moving contractor can expose himself to a law suit by spilling earth onto privately owned land, particularly if damage is caused in removing the earth from the land.

Another problem that has arisen in recent years is that concern with the ecology has become prevalent, and authorities in response to this concern, whenever pipelines and the like are installed across the country, have required among other things that valuable excavated top soil be kept on the surface and returned to its approximate original location in fundamentally the same state as when it was removed. Fulfilling this requirement is time consuming and often represents difficult work for conventional earth moving equipment, because considerable time and numerous traverses of the equipment are required, all of which translate into considerable expense.

SUMMARY OF THE INVENTION

To deal with the foregoing problems, I have invented an earth moving attachment which can be secured to a typical endless track vehicle and used for quickly and efficiently moving excavated earth from one position to another. My invention consists of a moving endless conveyor track, or similar device, which runs laterally and horizontally across the front face of a vertical blade-like device which is mounted at the front of the endless track vehicle in the same manner as conventional dozer blades. The lower portion of my attachment incorporates a blade, or similar device, which contacts the earth and does the actual cutting or excavating of the earth as the attachment is moved forward at the front of the endless track vehicle. The horizontal laterally moving endless conveyor track, or other suitable means, located at the front of the attachment can run in either direction so that the excavated earth can be moved to either side of the attachment.

The endless conveyor track on the attachment is powered by a plurality of hydraulic motors, or similar suitable driving devices, which are enclosed within a shield-like housing located at the top of the attachment. The plurality of hydraulic motors can be driven by a hydraulic power source which is the same as or is separate from the power source driving the endless track vehicle. The separate power source can be mounted on the vehicle at a suitable location, for example, at the rear of the vehicle, to assist in counterbalancing the weight of the attachment at the front of the vehicle.

My attachment is particularly advantageous in moving excavated earth back into long ditches such as those excavated for pipelines and for efficiently and cleanly removing top soil. The lateral speed of the conveyor track forming part of the attachment can be varied separate from the forward speed of the vehicle to ensure that the forward rate of advance of the endless track vehicle is synchronized with the lateral speed of the conveyor track. This maximizes the ability of the attachment to move the excavated earth according to the intention of the operator of the endless track vehicle.

The direction of travel of the laterally travelling conveyor track can be to either side of the vehicle and is reversible. If the vehicle operator sees that the earth is tending to build up ahead of the attachment, he simply either slows the vehicle or speeds up the lateral direction of travel of the track so that more earth is moved to the side in relation to the rate of forward advance of the vehicle. If the earth buildup is decreasing, the operator either accelerates the speed of the vehicle or slows the lateral speed of the track of the attachment. It is therefore possible to always strike a balance between the rate of advance of the track laterally and the rate of advance of the vehicle forwardly.

A particular advantage of my attachment is that there is no "spillage" or leakage of excavated earth by the "off-side" edge of the attachment. This is advantageous because it enables the operator of the vehicle to excavate earth immediately adjacent property lines, and the like, without depositing or having excavated earth spill over the property line. Accordingly, it is not necessary to run earth moving equipment on the adjacent property to move the excavated earth back to the property being worked.

Another advantage with the attachment is that the earth being excavated does not tend to become compacted, that is, compressed. The earth excavated stays loose and is easily moved. Further, the lighter, finer material tends to move ahead of the heavier material and drops into a ditch first, which is very useful in pipeline burying situations, because the danger of having heavy material, boulders, and the like, drop directly on and damaging the pipe is minimized.

A further advantage of my attachment is that because of the ease with which earth can be moved to the side, the number of back and forth passes that must be made is minimized, which reduces operator fatigue. The operator is fresher at the end of a day, using my attachment, and therefore does not tend to make as many mistakes an excavating and moving earth.

The invention is directed to an apparatus for moving earth comprising: (a) earth contacting means; (b) a means mounted in association with the earth contacting means for moving the earth in a direction lateral to the direction of travel of the earth contacting means; and (c) a vehicle for moving means (a) and (b) above in co-operation with one another.

The lateral earth moving means can be an endless track which presents a substantially vertical face to the direction of advance of the vehicle and which moves in a horizontal direction lateral to the direction of advance of the vehicle. The earth contacting means can be a blade. The laterally moving track can be mounted in association with and moved by at least one power driven sprocket. To save sprocket wear the main weight of the track can be supported by means other than the sprocket. The supporting means can be a plate mounted underneath the sprocket. A plurality of individually powered sprockets can be used to drive the track.

The direction of travel of the lateral earth moving means is reversible. The vehicle carrying the apparatus can be an endless track vehicle.

The invention is also directed to a method of moving earth. An earth moving means is advanced through a continuous ridge of earth in a manner such that the speed of advance of the advancing earth moving means is synchronized with the speed of movement of a laterally travelling earth moving means so that substantially all of the earth is moved laterally in the direction of travel of the laterally travelling earth moving means. The invention can include a method wherein top soil is laterally moved to one side by making one traverse with an earth moving means and the direction of travel of the earth moving means is then reversed and earth underlying the top soil is moved to the opposite side by making a second traverse of the earth moving means over the same path as the first traverse.

DRAWINGS

DETAILED DESCRIPTION OF THE INVENTION

Figure 1:
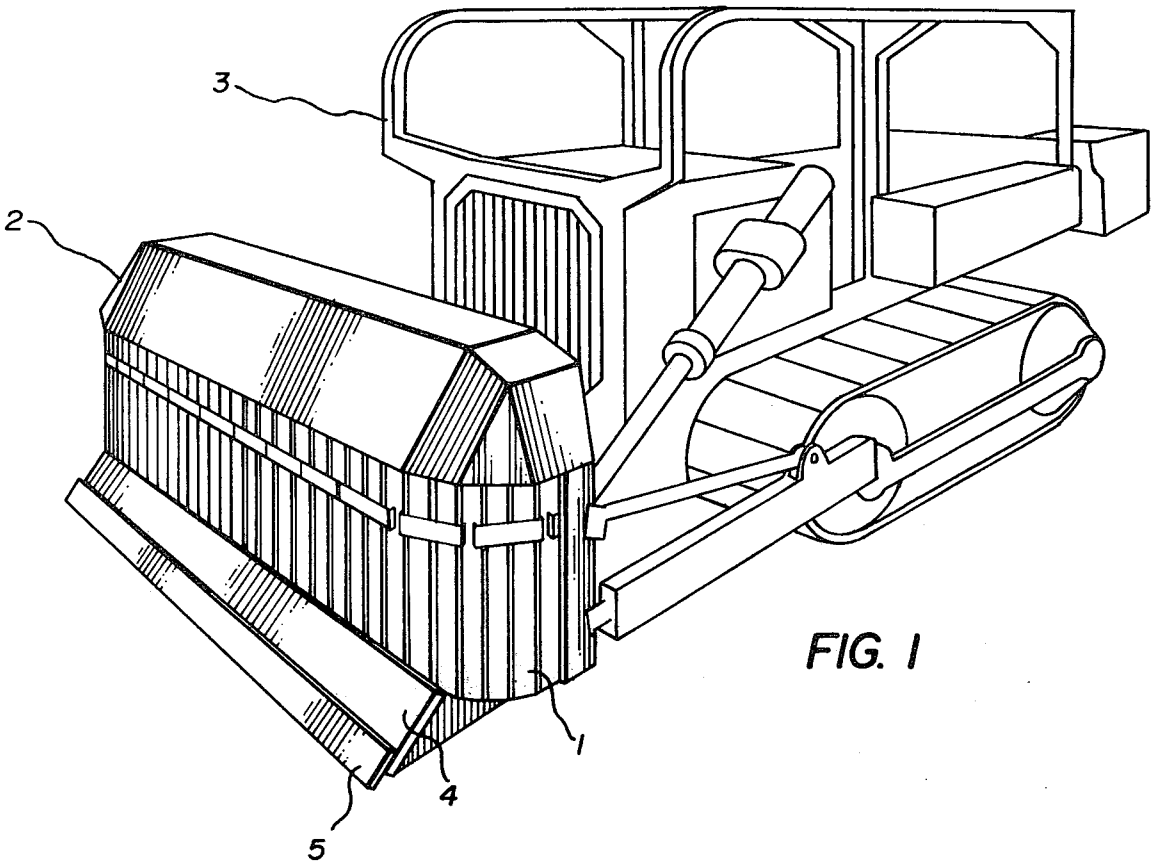
FIG. 1 illustrates a three dimensional view of the earth moving attachment mounted at the front end of an endless track vehicle.

Referring to FIG. 1, the attachment consists of a laterally mounted conveyor track 1 which runs around the horizontal circumference of the attachment. The main body of the attachment, as will be elaborated later, is constructed of a sturdy framework. A long shield 2 is mounted above the track 1 and is of approximately the same length as the track 1. Below and to the front of the track 1 is positioned a blade 4, with an optional removable cutting edge 5 secured to the blade 4. The entire attachment is mounted at the front end of a conventional endless track vehicle, such as a D-7*. (Identified in FIG. 1 as vehicle 3).

*Trade Mark of Caterpillar Tractor Company

Figure 2:
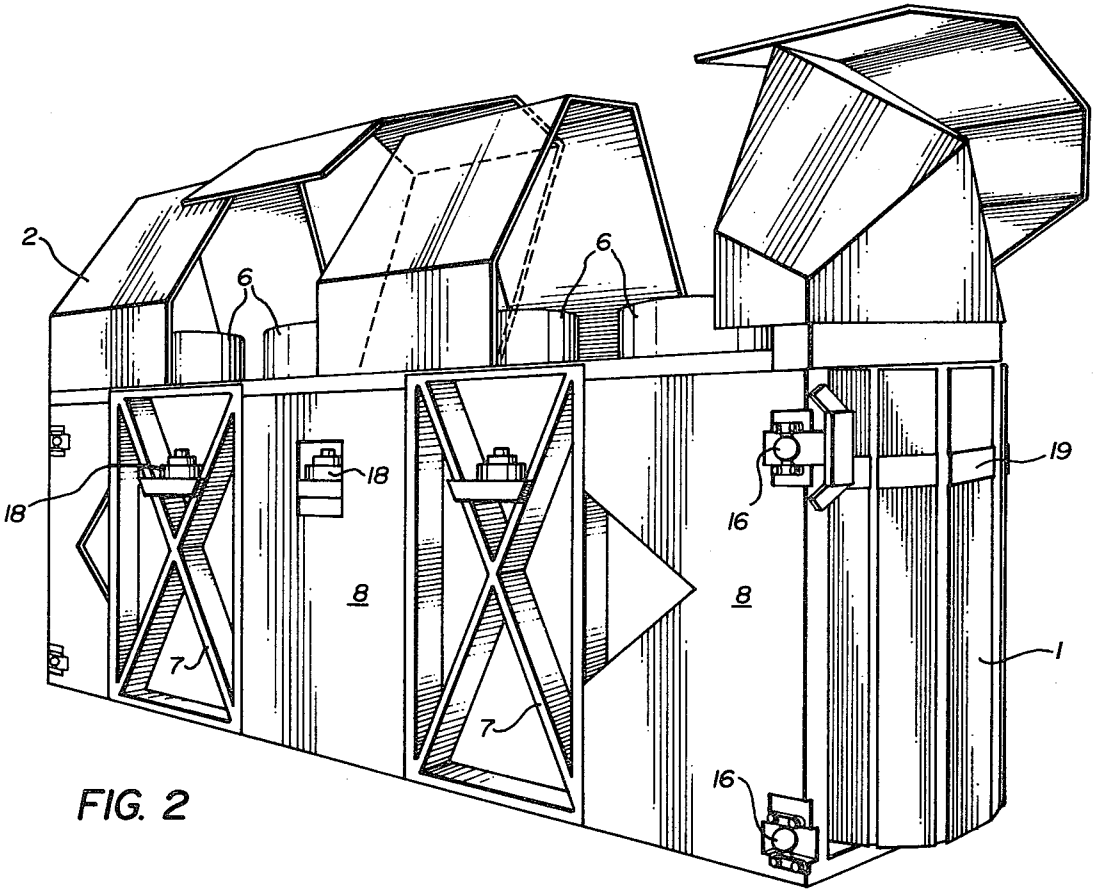
FIG. 2 illustrates a three dimensional view of the back face of the attachment.
Figure 3:
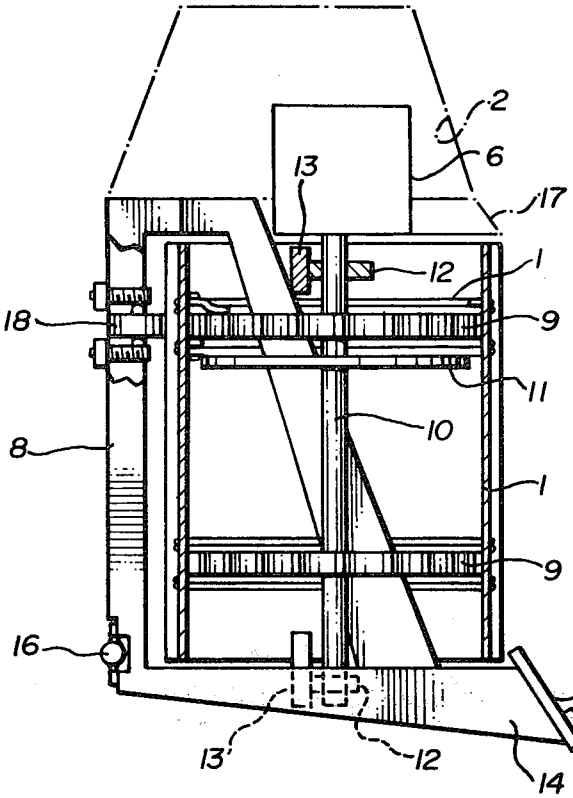
FIG. 3 illustrates a partially cut away side view of the attachment.

Referring to FIG. 2, which illustrates the back face of the attachment, it can be seen that the shield 2 is constructed as a number of individually hinged sections, secured to a bumper plate (See item number 17, FIG. 3). The combination of sections make up the overall shield 2 which, in the particular construction illustrated, houses five separate hydraulic motors 6 (four are visible in FIG. 2) which are driven by a hydraulic power source that is not shown. The hinged sections can be lifted so that maintenance work can be done on the motors 6. The hydraulic power source, which is normally separate from the hydraulic power source of the endless travel vehicle 3, can be mounted on the vehicle 3 or behind the attachment at some suitable position. It is preferable to mount the power source on the vehicle 3 at the rear to help counter-balance the weight of the attachment.

Since heavy earth must be moved, and considerable forces are involved, the back face of the attachment is strengthened with a system of reinforcing back braces 7. The rear face of the track 1 is protected by several guard plates 8 which help to strengthen the attachment. The hydraulic motors 6 are mounted on rotatable shafts that are secured to prevent rotation of the motors 6.

Mounting brackets 16, for securing the attachment to a conventional endless track vehicle are located at the approximate corners of the rear face of the attachment.

Referring to FIG. 3, which illustrates a partially cut away side view of the attachment, it can be seen that a dual sprocket 9 and axle 10 combination is mounted vertically within the attachment. The endless track 1 engages with and travels in combination with the dual sprocket 9 and axle 10 combination. While FIG. 3 illustrates only one dual sprocket 9 and axle 10 combination, there are in fact, in the construction illustrated, five dual sprocket 9 and axle 10 combinations mounted in linear series along the length of the attachment. There are also five hydraulic motors 6 which separately drive the five dual sprocket 9 and axle 10 combinations. In FIG. 3, the hydraulic motor 6 specific to the dual sprocket 9 and axle 10 combinations, as can be seen, is mounted at the top end of axle 10. The five hydraulic motors 6 are mounted directly on the axles 10 and are strongly secured by means of appropriate conventional bracing (not shown) within the attachment to two cross pieces 13 which essentially extend the length of the attachment (See FIG. 5 for additional detail). The tops and bottom ends of the axles 10 fit in upper and lower sprocket axle mountings 12 (bearings) which in turn are secured to the two cross pieces 13 (See FIG. 5 for further details).

A significant feature of the dual sprocket 9 and axle 10 combination is the utilization of a circular track carrying plate 11 positioned radially underneath the top sprocket 9. As can be seen in FIG. 3, components of the track 1 rest upon this track carrying plate 11. Thus, most of the weight is carried by the plate 11 and none of the actual weight of the track 1 is carried directly by the teeth of the dual sprockets 9. This construction greatly reduces internal friction forces (thereby reducing power requirements) within the system, and also greatly reduces expensive sprocket wear. Most of the wear occurs on the track carrying plate 11 which can be easily and relatively inexpensively replaced when it becomes worn.

Figure 4:
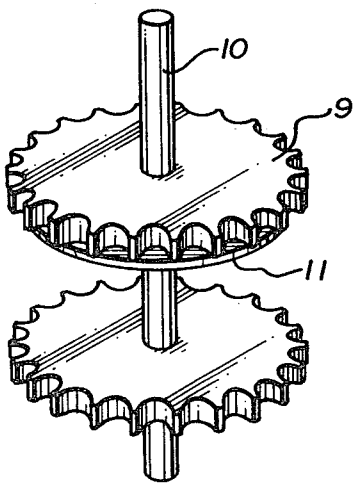
FIG. 4 illustrates a three dimensional view of the dual sprocket and axle arrangement.

FIG. 4 shows a perspective view of the dual sprocket 9, axle 10 and carrying plate 11 combination.

Figure 5:
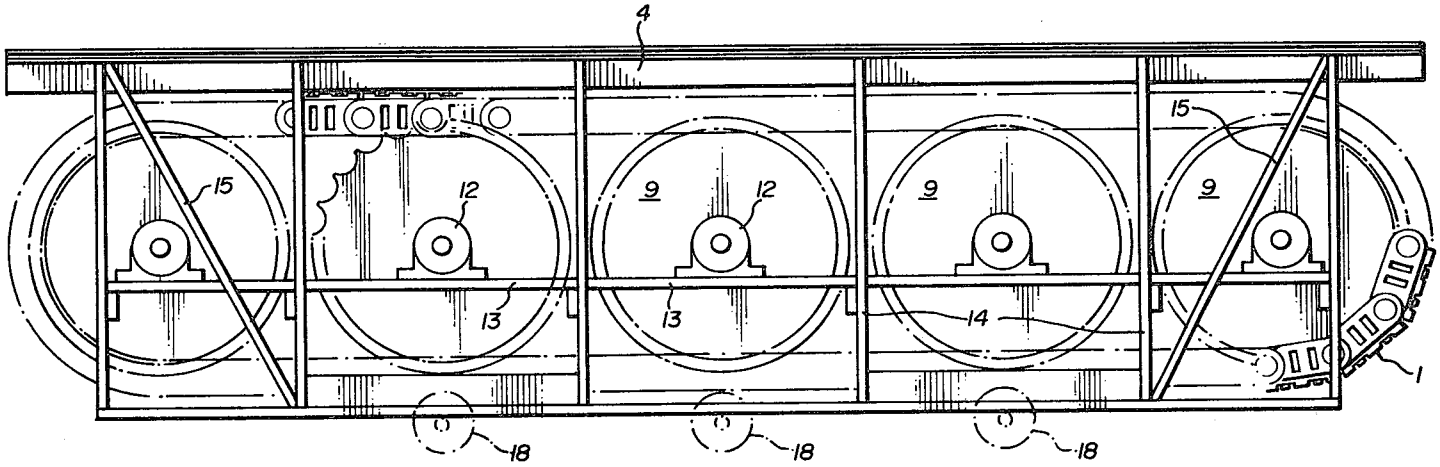
FIG. 5 illustrates a bottom elevational view of the attachment.

Referring to FIG. 5, which shows a bottom elevational view of the attachment, it can be seen that the five sprockets 9 are mounted in linear series by means of five sprocket axle mountings 12, which in turn are secured to cross pieces 13 which run substantially the length of the attachment. To provide additional internal strength to the attachment, so that the considerable forces encountered in moving earth can be withstood, six blade support frames 14 are located within the attachment. A side view showing the construction of the blade support frame 14 can be seen in FIG. 3. The combination of these six blade support frames 14 provides a sturdy rigid interconnected structure, without requiring an excessive amount of weight. To deal with diagonal stresses, two cross braces 15 are secured at each end of the attachment. The advantage of this construction is that while it strong it is also, comparatively speaking, relatively light in weight. FIG. 5 also illustrates the linkage involved in constructing the endless track 1 and how the linkage co-operates with the teeth of the sprocket 9.

To prevent the track 1 from coming off the sprockets 9 at the rear side of the attachment rollers 18 are mounted on the main frame. In the construction shown, three rollers 18 are mounted directly to the rear and corresponding in position with the three interior sprockets 9. These rollers 18 prevent the track 1 from "ovalizing" when the track is travelling rapidly and thus prevent the track 1 from disengaging from the sprockets 9 at the rear of the attachment. Rollers 18, as can be seen in FIGS. 2 and 3, are mounted on shafts in respective hubs so that their respective positions can be adjusted inwardly or outwardly in relation to the track 1. The track 1 has a series of steel plates 19 welded around the circumference of the track 1. These plates 19 are positioned so that they run on the rollers 18. The plates 19 prevent vibration that would occur if the rollers ran on the irregular surface of the track 1.

The rollers 18 have an additional advantage in that by keeping the track 1 on the sprockets 9, and the track 1 running smoothly, the motors 6 run in unison so that one motor does not tend to rob hydraulic fluid from another motor 6.

Figure 6:
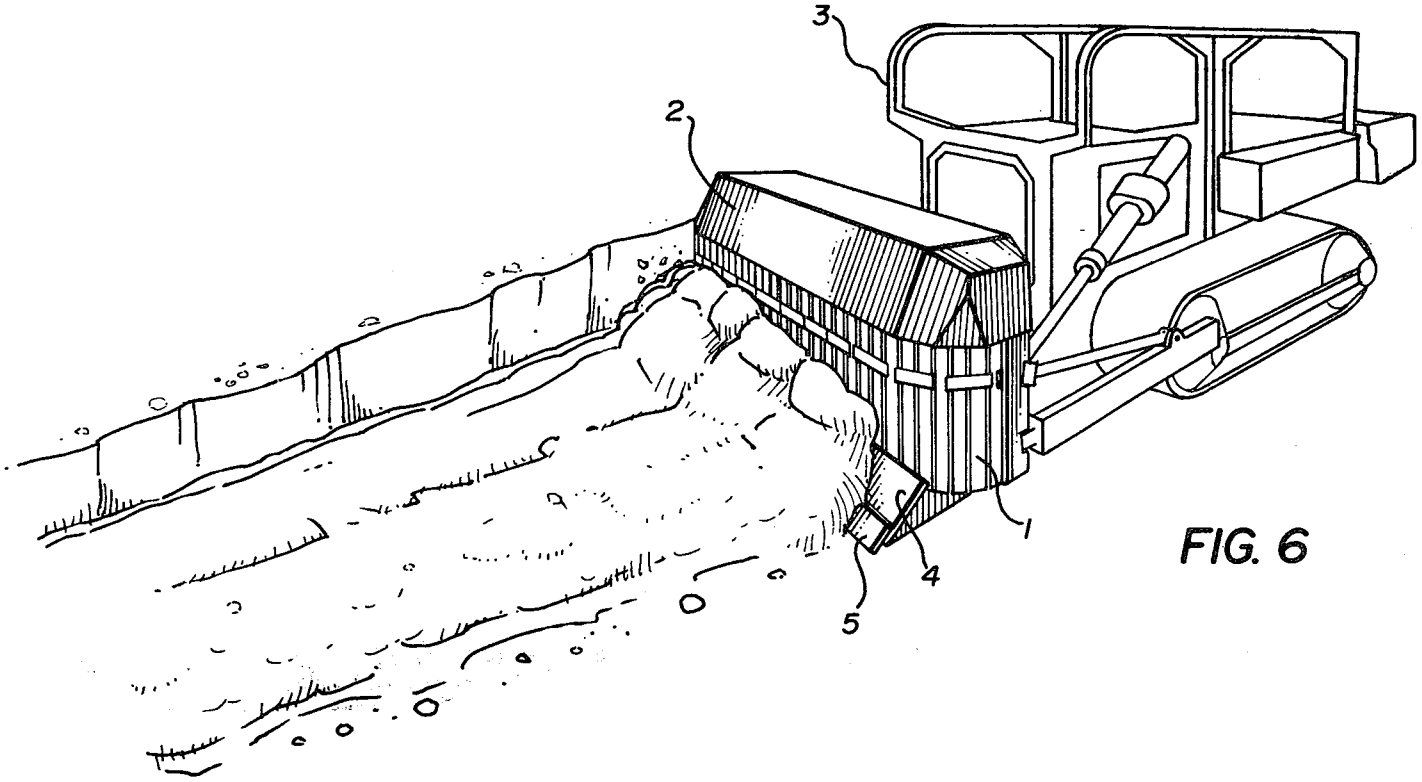
FIG. 6 illustrates a three dimensional view of the attachment mounted on an endless track vehicle moving earth in a longitudinal ditch.

FIG. 6 illustrates the attachment mounted in operation at the front end of an endless track vehicle 3 as it moves excavated earth back into a ditch which runs alongside the excavated earth. By using the attachment on the front end of the endless track vehicle, the earth can be quickly and efficiently moved back into the ditch with one pass, leaving a very clean and manicured job to the earth surface.

I have found that a prototype of my attachment mounted at the front of a D-7 (Trade Mark) endless track vehicle is so efficient that in terms of time and amount of earth efficiently moved, it will out perform a much larger D-9 endless track vehicle equipped with a dozer blade commonly used to fill a ditch excavated for a ten-inch pipeline. Furthermore, I have found that in using a prototype of my invention, I can back-fill a ditch excavated for a 24-inch pipeline at a rate three to four times as fast as the same ditch can be back-filled using a D-9 endless track vehicle equipped with a standard dozer blade. Some of the earth, as the D-9 vehicle back-filled the earth into the ditch, consistently spilled over or "leaked" by the off-side edge of the blade, necessitating repeated passes of the vehicle in order to move this earth to its proper destination and leave a smoothly finished surface. On the other hand, the D-7 using my attachment, and synchronizing the speed of the track with the speed of advance of the D-7, moved all earth to the intended side of the vehicle, with no "leakage" or spillage by the off-side and the intended destination, and no back tracking was necessary. A smooth, manicured job was achieved with one pass. Savings to contractors, and the like, using my attachment, should be in the order of 25 percent to 35 percent, which savings should be reflected in lower bid prices, land costs, and the like.

A further advantage of my apparatus is that by utilizing five separate hydraulic motors, in the embodiment illustrated, the conveyor track is driven at five different points along the track and accordingly is moved smoothly along in a lateral direction, notwithstanding the considerable forces that might be applied against the track by the earth being pushed ahead or to one side. This is a distinct improvement over a construction where the track is driven by one drive sprocket only, with the track supported by idler rollers. The latter design would cause severe stress and strain to the track and related equipment.

The reduced internal friction forces resulting from reduced strain greatly increase the lifetime of the track by minimizing frictional wear within the moving elements of the track. By using five drive sprockets arranged in series within the circumference of the endless track of my attachment, whereby each sprocket engages actively with the linkage in the interior of the track, "ovalization" of the track is minimized. Ovalization is a severe problem when an endless track of substantial weight having only one drive sprocket and idler rollers is revolved rapidly without any load being exerted on the track. Ovalization is detrimental in the operation in most endless track systems because the track applies severe forces to the sprockets, and tends to move away from the rollers whereby the track is then prone to disengage from the sprocket. To prevent ovalization at the rear of the track I use three tightening rollers to hold the track against the sprockets.

As with conventional dozer blades, my attachment can be operated efficiently by mounting it at an angle to the direction of travel, for example, twenty-five degrees. However, the attachment can be mounted with no angle, if this is required, for example, in straight fill pushing situations.

While particular embodiments of the present invention have been shown and described, it is apparent that various changes and modifications may be made, and it is therefore intended in the following claims to cover all such obvious modifications and changes as may fall within the true spirit and scope of this invention.

The embodiments of the invention in which an exclusive property or privilege is claimed are defined as follows:

1. Apparatus for moving earth comprising:

(a) a vehicle;

(b) earth contacting means mounted on said vehicle (a) for moving earth in one direction;

(c) a reversible horizontally traveling endless track earth moving means mounted on said vehicle above said earth contacting means for moving earth lateral to said one direction;

(d) at least two independent reversible direct drive means driving said endless track (c); and (e) means for supporting the weight of the endless track (c) independently of the drive means (d).

2. Apparatus according to claim 1 wherein the reversible horizontally traveling endless track (c) presents a substantially vertical face to the direction of horizontal advance of the vehicle and moves in a horizontal direction lateral to the direction of travel of the vehicle.

3. Apparatus according to claim 2, including restraining means for holding said reversible endless track in driving engagement with the drive means (d).

4. Apparatus according to claim 3, wherein said restraining means is movable toward and away from said endless track to adjust the restraining force on said endless track.

5. Apparatus according to claim 1 or 2, wherein said supporting means (e) comprises a plate mounted on each reversible drive means (d).

6. Apparatus according to claim 5, wherein each of said reversible drive means (d) comprises a drive sprocket and a shaft, said shaft mounting both said sprocket and said plate.

7. Apparatus according to claim 1, wherein vehicle (a) is an endless track vehicle.

* * * * *